US008773217B2

(12) United States Patent
Dupont et al.

(10) Patent No.: US 8,773,217 B2
(45) **Date of Patent: *Jul. 8, 2014**

(54) INTEGRATED BIDIRECTIONAL COUPLER

(71) Applicant: STMicroelectronics (Tours) SAS, Tours (FR)

(72) Inventors: François Dupont, Tours (FR); Hilal Ezzeddine, Tours (FR); Sylvain Charley, Mettray (FR)

(73) Assignee: STMicroelectronics (Tours) SAS, Tours (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/907,455

(22) Filed: May 31, 2013

(65) Prior Publication Data

US 2013/0257559 A1 Oct. 3, 2013

Related U.S. Application Data

(63) Continuation of application No. 12/273,122, filed on Nov. 18, 2008, now Pat. No. 8,476,987.

(30) Foreign Application Priority Data

Nov. 20, 2007 (FR) ..... 07 59185

(51) Int. Cl.
*H01P 5/12* (2006.01)
*H01P 5/18* (2006.01)

(52) U.S. Cl.
USPC ..... 333/109; 333/116

(58) Field of Classification Search
USPC ..... 333/109, 110, 111, 112, 115, 116
See application file for complete search history.

(56) References Cited

U.S. PATENT DOCUMENTS

| | | | | |
|---|---|---|---|---|
| 4,754,241 | A | 6/1988 | Spinner | |
| 5,006,821 | A | 4/1991 | Tam | |
| 5,138,325 | A | 8/1992 | Koury | |
| 5,363,071 | A | 11/1994 | Schwent et al. | |
| 6,803,818 | B2 | 10/2004 | Van Amerom | |
| 7,026,887 | B2 | 4/2006 | Watanabe et al. | |
| 7,961,064 | B2 * | 6/2011 | Kearns et al. | 333/109 |
| 8,384,494 | B2 * | 2/2013 | Laporte et al. | 333/110 |
| 8,476,987 | B2 * | 7/2013 | Dupont et al. | 333/109 |
| 8,536,956 | B2 * | 9/2013 | Tamaru et al. | 333/112 |
| 2004/0061571 | A1 | 4/2004 | Pozdeev | |
| 2006/0119452 | A1 | 6/2006 | Kim et al. | |
| 2012/0062333 | A1 * | 3/2012 | Ezzeddine et al. | 333/116 |

FOREIGN PATENT DOCUMENTS

JP 2000022411 A 1/2000

OTHER PUBLICATIONS

French Search Report dated Jul. 11, 2008 from French Patent Application No. 07/59185.

* cited by examiner

*Primary Examiner* — Dean O Takaoka
(74) *Attorney, Agent, or Firm* — Wolf, Greenfield & Sacks, P.C.

(57) ABSTRACT

A distributed-line directional coupler including: a first conductive line between first and second ports intended to convey a signal to be transmitted; and a second conductive line, coupled to the first one, between third and fourth ports, the second line being interrupted approximately at its middle, the two intermediary ends being connected to attenuators.

6 Claims, 5 Drawing Sheets

INTEGRATED BIDIRECTIONAL COUPLER

CROSS REFERENCE TO RELATED APPLICATIONS

This application is a continuation of U.S. patent application Ser. No. 12/273,122, filed on Nov. 18, 2008, which claims the priority benefit of French patent application number 07/59185, filed on Nov. 20, 2007, which applications are hereby incorporated by reference to the maximum extent allowable by law.

BACKGROUND OF THE INVENTION

1. Field of the Invention

The present invention generally relates to the electronic industry and, more specifically, to radio-frequency transceiver systems. The present invention more specifically relates to a bi-directional coupler and to its applications.

2. Discussion of the Related Art

A coupler is generally used to draw part of the power present on a so-called main or primary transmission line towards another so-called coupled or secondary line located in the vicinity.

Couplers are distributed in two categories according to whether they are formed of discrete passive components (it is then spoken of couplers with local elements) or of conductive lines close to one another to be coupled (it is then spoken of couplers with distributed lines). The present invention relates to the second category of couplers.

In many applications, part of the power transmitted over a line needs to be sampled, for example, to control the power of amplifiers in a transmit circuit, to control the linearity of a transmit amplifier according to the losses due to the reflection of an antenna, to dynamically match an antenna, etc.

A coupler can be defined, among other things, by its directivity, which represents the power difference (expressed in dBm) between the two access ports of its coupled or secondary line.

Theoretically, an ideal coupler has an infinite directivity, that is, no power is present on the port of its secondary line located opposite to the output port of its main line when a signal flows on its main line from the input port to this output port. In practice, a coupler is said to be directional when its directivity is sufficient (typically greater than +20 dB) for the powers recovered on the access ports of its secondary line to enable making out the flow direction of the power in the main line. When the two ports of the coupler are used to simultaneously have the power information on the two ports of its secondary line, the coupler is said to be bi-directional.

If the two ports of its secondary line and the output port of its main line are perfectly matched, no parasitic reflection occurs. Such a perfect matching is difficult to obtain in practice. In particular, the port from which the power portion is sampled by coupling is seldom ideally matched. As a result, parasitic reflections generate errors on the recovered information.

A mismatch of the secondary line port of the coupler from which the information is sampled may have different sources. Most often, the coupler is placed on an insulating substrate (for example, of printed circuit type) to be associated with other circuits. It is then not possible to ensure a perfect matching (typically, at 50 ohms) of the measurement port.

To attempt overcoming this problem, it has already been provided to equip the ends of the secondary line with attenuators. However, at constant coupling factor, this requires increasing the coupling, and thus the coupler size, and thus increases transmission losses. Further, this only postpones the problem of parasitic reflections, which then appear for higher levels of mismatch of the secondary line ports.

SUMMARY OF THE INVENTION

Thus, it would be desirable to overcome all or part of the disadvantages of usual couplers.

It would also be desirable to improve the reliability of the measurements by the coupler on the ports of its secondary line.

It would also be desirable to make the measurement insensitive to a variation of the matching of the circuits connected on the measurement port.

At least one embodiment enables significantly decreasing the coupler bulk.

At least one embodiment forms a dual-path coupler.

At least one embodiment of the present invention provides a distributed-line directional coupler comprising:

a first conductive line between first and second ports intended to convey a signal to be transmitted; and a second conductive line, coupled to the first one, between third and fourth ports, the second line being interrupted approximately at its middle, the two intermediary ends being connected to attenuators.

According to an embodiment, the two attenuators have values of at least half the directivity factor of the coupler.

At least one embodiment of the present invention also provides a directional coupling circuit comprising two couplers interconnected by two resistive power separators.

At least one embodiment of the present invention also provides a circuit for transmitting or receiving radio-frequency signals, comprising: at least one amplifier;

at least one coupler; and at least one circuit for measuring information sampled from one of the ports of the second line.

The foregoing objects, features, and advantages of the present invention will be discussed in detail in the following non-limiting description of specific embodiments in connection with the accompanying drawings.

DETAILED DESCRIPTION

Figure 1:
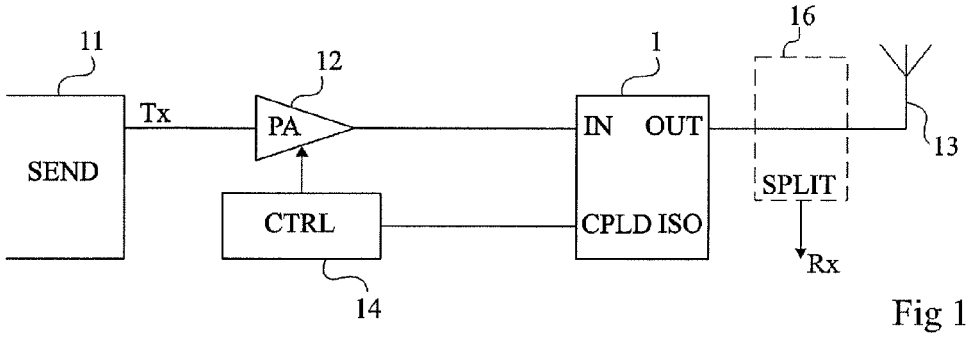
FIG. 1 is an example of architecture of a radio-frequency transmission path of the type to which the present invention applies as an example.

The same elements have been designated with the same reference numerals in the different drawings. Further, for clarity, only those elements which are useful to the understanding of the present invention have been shown and will be described. In particular, the different possible exploitations of the signal sampled from the secondary line of the coupler have not been detailed, the present invention being compatible with any current use.

FIG. 1 is a block diagram of a radio-frequency transmission line using a coupler 1 of the type to which the present invention applies as an example.

A transmit circuit 11 (SEND) sends a signal Tx to be transmitted to an amplifier 12 (PA) having its output intended to be connected to an antenna 13. A main line of a coupler 1 is interposed between the output of amplifier 12 and antenna 13. A so-called access port IN is on the side of amplifier 12 while a so-called access port OUT (sometimes also designated as DIR) is on the antenna side. A coupled or secondary line of the coupler samples part of the power of the main line. A port CPLD of the coupler, corresponding to the end of the secondary line on the side of port IN, provides information about the measurement. Such information depends, among other things, on the losses due to the reflection by the antenna. It being a directional coupler, end ISO of the secondary line, on the side of port OUT, is not used. It is loaded with the reference impedance of the circuit (typically 50 ohms). In the example of FIG. 1, the measurement is used to match the amplifier gain by means of a circuit 14 (CTRL) receiving the information sampled from port CPLD and controlling the gain of amplifier 12. The measurement of the return losses of the antenna may also enable a dynamic matching of the antenna if it has this functionality.

If necessary, a path splitter 16 (SPLIT) is interposed between coupler 1 and antenna 13. Such a splitter is used to separate the transmission from the reception (flow Rx in FIG. 1) which is processed by a radio-frequency reception line, not shown.

Figure 2:
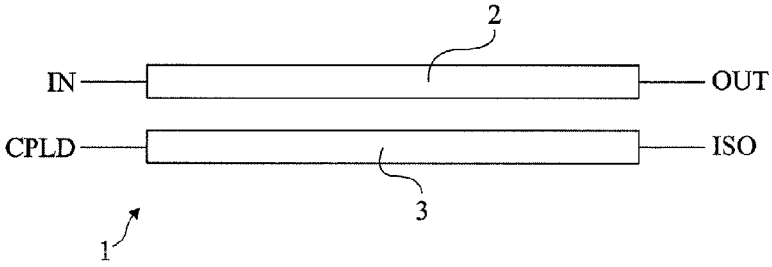
FIG. 2 shows an example of a distributed-line coupler.

FIG. 2 is a simplified view of a distributed-line coupler. A main line 2 of coupler 1 is intended to be interposed on the transmission line and comprises two respective input and output ports or terminals IN and OUT. A secondary line 3 comprises two ports or terminals, respectively CPLD and ISO and is intended to convey the information proportional to the power transmitted in line 2. Lines 2 and 3 are, in practice, formed of conductive tracks supported by an insulating substrate. The lengths of the lines depend on the desired operating frequency. Their width depends on the searched directivity and characteristic impedance.

The coupler of FIG. 2 is directional, since the signals present on ports CPLD and ISO do not have the same levels. Such a coupler is however symmetrical, which makes its bi-directional, that is, in the same way as a signal applied on terminal IN is coupled on terminal CPLD, a signal applied on terminal OUT is coupled to the level of terminal ISO. Accordingly, a reflection of the antenna can be found on port ISO of the coupler. In a symmetrical directional coupler such as illustrated in FIG. 2, the functions of the terminals are defined by the connections of the coupler to the other elements.

The main parameters of a coupler are:

the insertion losses, which represent the transmission loss between the two access ports of the main line (the insertion losses are defined while the two other coupler ports are loaded with a 50-ohm impedance);

the coupling, which represents the transmission loss between ports IN and CPLD (the coupling is then defined while the two other ports OUT and ISO are loaded with a 50-ohm impedance);

the isolation, which represents the transmission loss between ports IN and ISO (the isolation is then defined while the two other ports OUT and CPLD are loaded with a 50-ohm impedance); and the directivity, which represents the difference in transmission losses between ports ISO and CPLD, from port IN.

Figure 3A:
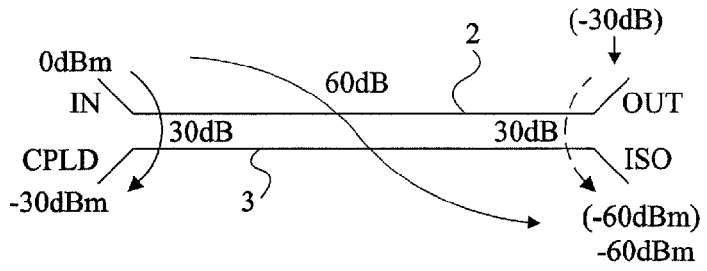
FIGS. 3A, 3B, and 3C are simplified representations of the coupler of FIG. 2 illustrating three operation situations.
Figure 3B:
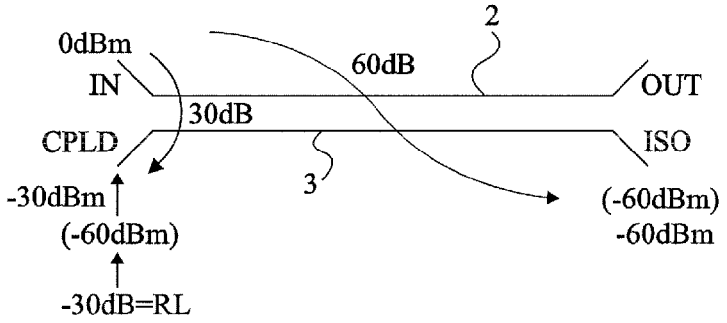
Figure 3C:
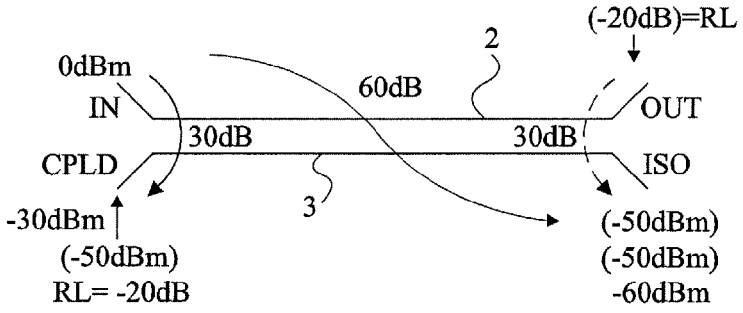

FIGS. 3A, 3B, and 3C illustrate the operation of the coupler of FIG. 2 in three examples of situations.

As indicated previously, a coupler is never perfect. It is considered that it has a good directivity if said directivity is of at least 20 dB. With a −30-dB coupling (which corresponds to sampling 1/1000 of the transmitted power), the isolation is on the order of −50 dB, which is acceptable. Ideally, the antenna absorbs the entire signal without generating any reflection.

However, the antenna has a non-zero reflection factor. This results in return losses which reach port OUT. The measurement of these losses is useful. This measurement exploits the coupling between terminals OUT and ISO.

However, return losses also occur on port CPLD since the impedance matching of this port is in practice not perfect. Such parasitic reflections may distort the measurements of the return losses of the antenna (more generally, of the coupler load).

The example of FIG. 3A illustrates a theoretical case of coupler operation where ports IN, CPLD, and ISO are perfectly matched (all loaded with 50 ohms), so that no reflection occurs on terminal CPLD. In the following examples, a 30-dB directivity is assumed. The reflection operation data are illustrated in brackets in the drawings.

Assuming that input IN is driven by a signal, for example at 0 dBm, the information received on terminal CPLD has a −30-dBm level due to the 30-dB coupling coefficient. Assuming that the antenna exhibits 30-dB return losses, it returns a signal at −30-dBm onto terminal OUT. Since the coupler is symmetrical, an incoming signal on terminal OUT is coupled on terminal ISO with a −30-dB coupling (dotted lines in FIG. 3A). As a result, the reflected signal exhibits a −60-dBm level on terminal ISO. If the reflected signal is in phase with the isolation signal (which also is at a −60-dBm level), the resultant exhibits a −54-dBm level to be compared to the expected −60-dBm if the coupler had been ideal (the signal measured by the circuit connected to terminal CPLD in fact is the difference between the levels seen by terminals CPLD and ISO). However, if the signals are in phase opposition, the level of their resultant (−∝dBm) is no longer detectable and the error on the measurement of the return loss coefficient (RL) presented to the antenna becomes infinite. The signal exploited on terminal CPLD thus indicates a level corresponding to no return losses while there actually are some.

The above operation shows that the coupler operating limit is linked to its directivity. If the return losses correspond to an attenuation greater than the directivity (reflected signal more attenuated than the directivity factor), they can no longer be detected.

FIG. 3B illustrates another theoretical case where the antenna is perfect, but where the load connected to port CPLD is not perfectly matched, that is, is different from 50 ohms. The case of a port CPLD generating a −30-dB reflection is assumed. In this case, port ISO sees not only a signal at −60-dBm resulting from the isolation (coupling+directivity), but also a signal at −60-dBm resulting from the conduction on the secondary line of the reflection on terminal CPLD. Here again, the losses may make the resultant on port ISO infinitely low. The limit also is −30 dB of return losses. This means that if port CPLD exhibits a matching defect such that it generates a reflection of a level greater than −30 dB, the results are significantly distorted. Now, it is difficult to guarantee losses smaller than −30 dB because of the circuits connected on port CPLD.

FIG. 3C illustrates a real case where the load connected to terminal CPLD and to the antenna generate return losses (for example, of −20 dB). The signal reflected by the antenna can be found on terminal ISO with a −50-dBm amplitude, as well as the signal reflected by the coupled terminal. This results again in a risk of not detecting the return loss level according to the signal phase. Further, it is enough for return losses to be identical on the antenna and on port CPLD for the problem to appear. Accordingly, the detection threshold becomes uncontrollable.

Figure 4:
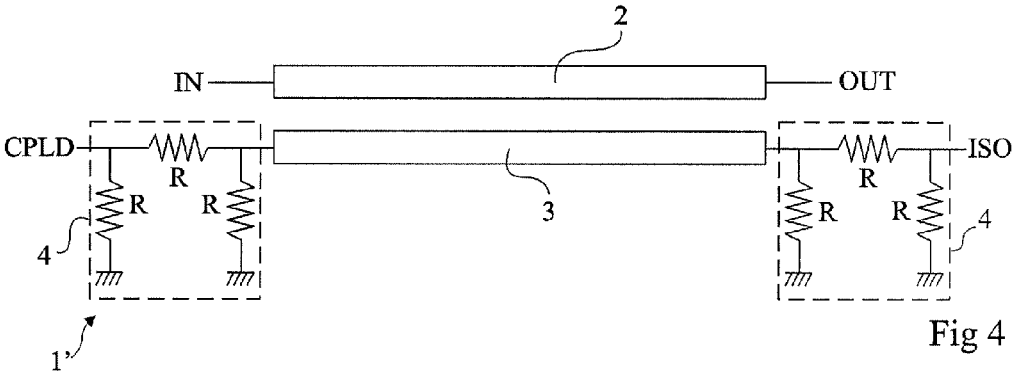
FIG. 4 shows another example of a distributed-line coupler.

FIG. 4 shows a coupler 1 having its ports CPLD and ISO loaded with attenuators 4. In the example, attenuators formed of three pi-coupled resistors R are assumed. A first resistor R is interposed in series at each end of the line while the two other resistors ground the two ends of the first resistor.

Figure 5A:
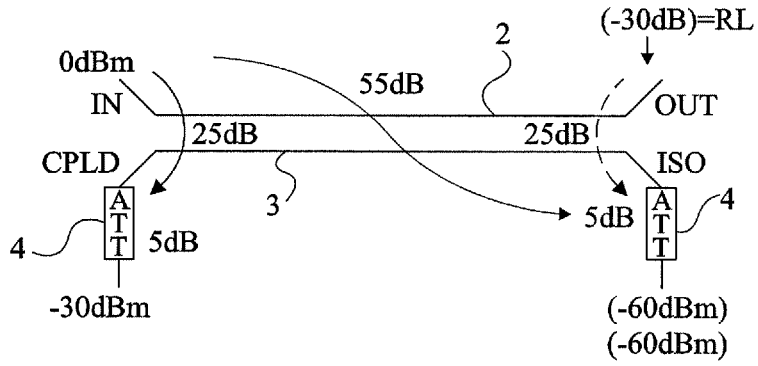
FIGS. 5A, 5B, and 5C are simplified representations of the coupler of FIG. 4 illustrating three operation situations.
Figure 5B:
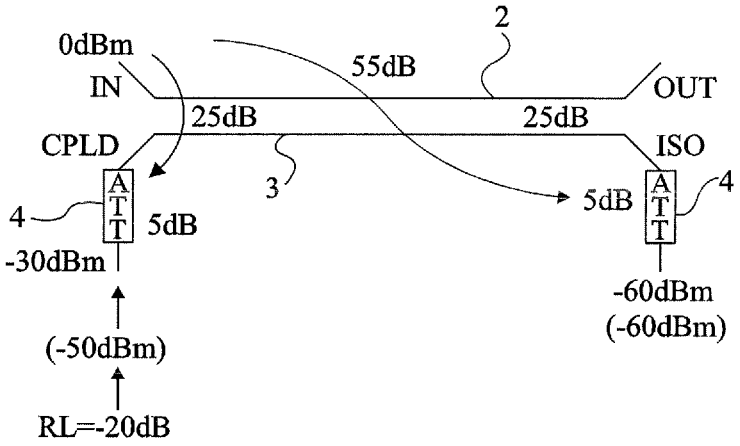
Figure 5C:
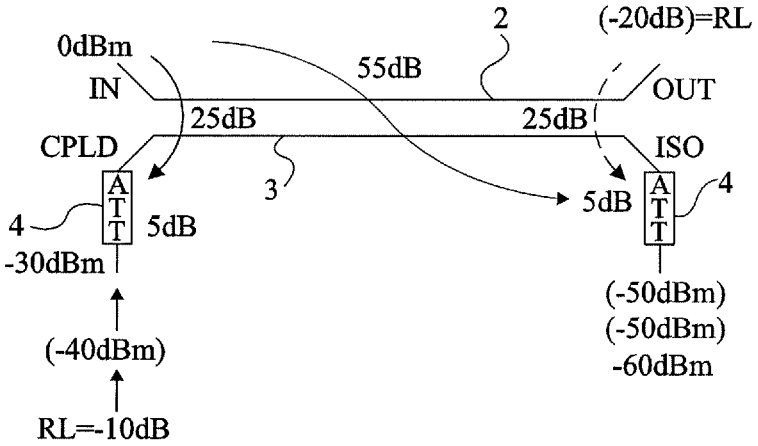

FIGS. 5A, 5B, and 5C illustrate the same cases as in FIGS. 3A, 3B, and 3C for the coupler of FIG. 4. It is assumed that the attenuators are of 5 dB. The presence of the attenuator on the side of coupled terminal CPLD requires increasing the coupling, that is, the attenuation between terminals CPLD and IN is then only 25 dB. Similarly, with a 30-dB directivity, the isolation between terminals IN and ISO becomes −55 dB.

In FIG. 5A, a perfect matching on the side of port CPLD and an antenna having −30-dB return losses are assumed. The presence of the attenuators changes nothing with respect to the case of FIG. 3A, that is, the coupler only operates if the return losses are lower than the directivity.

In FIG. 5B, it is assumed that port CPLD introduces a reflection attenuated by 20 dB with respect to the received signal and that the antenna is perfect. For an input signal (terminal IN) at 0 dBm, port CPLD receives, in reflection, a signal at −50-dBm. This signal crosses back the attenuator of terminal CPLD and can be found, once attenuated by that of terminal ISO, at the same level (−60 dBm) as that coming from terminal IN which has been attenuated by 55 dB by the isolation, then by 5 dB by the attenuator of terminal ISO. A problem can thus arise according to the phase of the signals. For this type of losses, the operating limit remains linked to the directivity (−30 dB) decreased by twice the value of the attenuators, that is, −20 dB. The presence of the attenuators thus improves the coupler. However, the threshold remains a function of the return losses on the side of port CPLD. Accordingly, the value of the attenuators cannot be increased too much without altering the other parameters.

The case of FIG. 5C should be compared with that of FIG. 3C. Return losses of 20 dB by the antenna and of 10 dB by port CPLD are assumed. A signal at 0 dBm on terminal IN can be found at −30 dBm at port CPLD (−25-dB coupling and 5-dB attenuation). The signal reflected at −40 dBm is attenuated again by 5 dB and reaches port ISO where it is attenuated again by 5 dB. The final level thus is −50 dBm. The same signal reflected by the antenna at −20 dB is coupled on terminal ISO with a −25-dB coefficient and attenuated by the 5-dB attenuator. It can thus also be found with a −50-dBm level. The possibility to detect the return losses thus depends again on the signal phase. For the antenna, the operating limit (here, −20 dB) corresponds to a reflection coefficient lower than the directivity (here, −30 dB) minus the difference (here, −10 dB) between the return losses of the antenna (here, −20 dB) and of port CPLD (here, −10 dB). For port CPLD, the limit (here −10 dB) corresponds to that of the antenna decreased by twice the value of the attenuators. As compared with the case of FIG. 3, losses on the antenna side can thus be detected even if they are of higher level (less attenuated) than the directivity and even if port CPLD is less matched.

However, return loss detection possibilities depend on the very value of these return losses.

Further, the presence of the attenuators on ports CPLD and ISO increases the coupling, and thus insertion losses.

Figure 6:
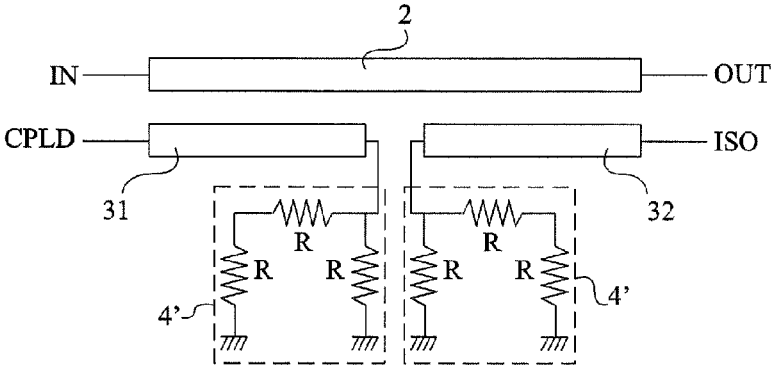
FIG. 6 shows an embodiment of a coupler.

FIG. 6 shows an embodiment of a coupler. This view should be compared with that of FIGS. 2 and 4. It shows main line 2 between access ports IN and OUT. However, the secondary or coupled line is divided in two sections 31 and 32, preferably symmetrical, that is, of same length. The respective external ends of sections 31 and 32 are connected to terminals CPLD and ISO. The respective internal ends are connected to attenuators 4'.

Attenuators 4' are preferably selected to provide an attenuation at least equal to half the coupler directivity. Taking the example of a coupler at 30 dB, this means that attenuators 4' each are of at least 15 dB.

The splitting of the coupled line and the presence of attenuators on the internal ends of sections 31 and 32 has several advantages:

each of the sections can be adjusted independently from the other; and the quality of the coupler rests on attenuators 4' and no longer on the loads presented on ports CPLD and ISO.

Figure 7A:
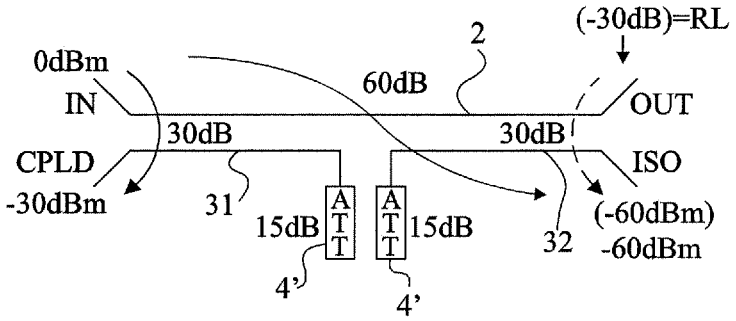
FIGS. 7A, 7B, and 7C are simplified representations of the coupler of FIG. 6 illustrating three operation situations.
Figure 7B:
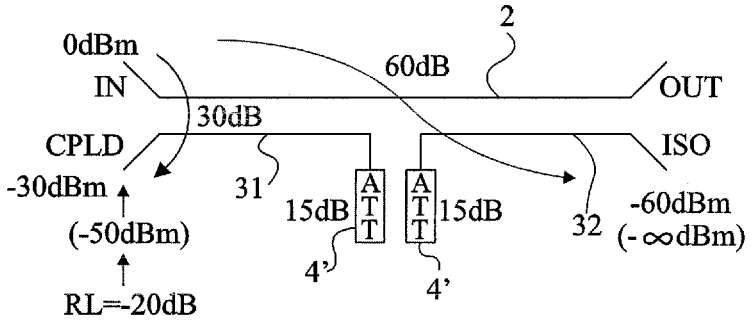
Figure 7C:
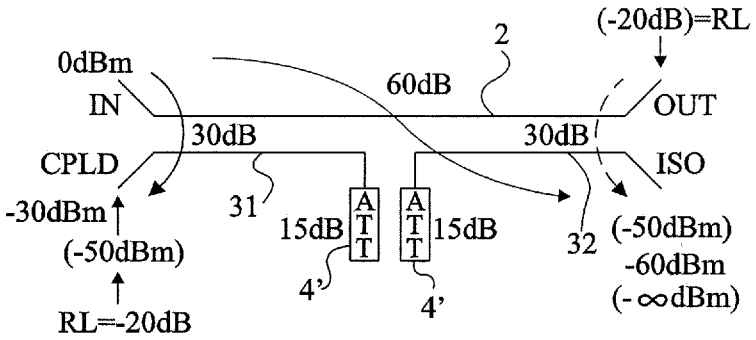

FIGS. 7A, 7B, and 7C are views to be compared with those of FIGS. 3 and 5 and illustrate the operation of the coupler of FIG. 6 in the case of a −30-dB coupling and of a 30-dB directivity.

FIG. 7A illustrates the theoretical operating limit regarding return losses on the side of terminal OUT. This limit is not modified, that is, it remains for return losses smaller than the directivity.

FIG. 7B illustrates the theoretical case of a perfect antenna with −20-dB return losses on the side of terminal CPLD. A signal at 0 dBm on terminal IN is coupled on terminal CPLD and arrives with a −30-dBm level. The reflected signal has a −50-dBm level. This signal however does not reach terminal ISO over the secondary line (infinite attenuation (−∝dBm)). The signal at 0 dBm directly coupled on terminal ISO is attenuated by 60 dB (coupling+directivity). Accordingly, the problem of FIGS. 3B and 4B cannot appear in this case.

FIG. 7C illustrates an example of a real case of −20-dB return losses on the antenna and on port CPLD. A signal at 0 dBm on input IN is reflected by the antenna and becomes coupled on terminal ISO where it arrives with a −50-dBm level. The input signal at 0 dBm arrives through the isolation at −60 dBm on port ISO. The same signal at 0 dBm arrives at −30 dBm on port CPLD where it is reflected. The signal reflected at −50 dBm only arrives on terminal ISO with a very high attenuation. The −50-dBm level is no longer masked by other less attenuated signals and thus becomes detectable by using two detectors. The risk exhibited in relation with FIGS. 3C and 4C no longer exists.

An advantage of the coupler of FIG. 6 thus is that its operating limit is no longer linked to the load on terminal CPLD, and thus to the matching of the measurement circuits. Further, it can be considered that it is no longer linked to the antenna other than with the directivity limit.

Figure 8:
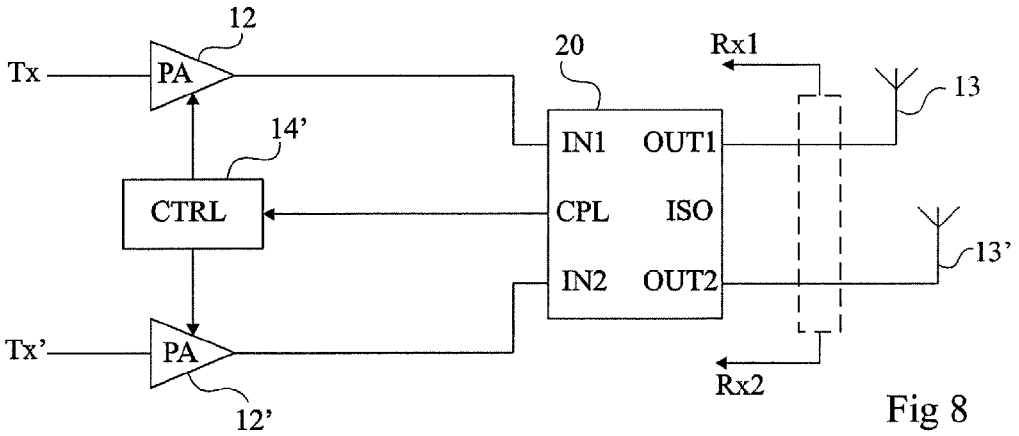
FIG. 8 shows an example of architecture of a dual-path transmission line.

FIG. 8 is a block diagram of a dual-path transmission chain. Two amplifiers 12 and 12' receive signals Tx and Tx' to be transmitted and share the same coupler 20 that they respectively drive on two input terminals IN1 and IN2. Output OUT1 and OUT2 of the main coupler lines are connected to two antennas 13 and 13', possibly via splitters enabling making out transmit flows from receive flows Rx1 and Rx2. Coupler 20 only has one secondary line having its terminal CLPD sent onto an interpretation circuit. In the shown example, it is assumed that the latter is a circuit 14' for controlling the gain of amplifiers 12 and 12', but it may also be an antenna matching circuit. Circuit 14' has two outputs towards respective amplifiers 12 and 12'. The switchings between the two paths are usual.

Figure 9:
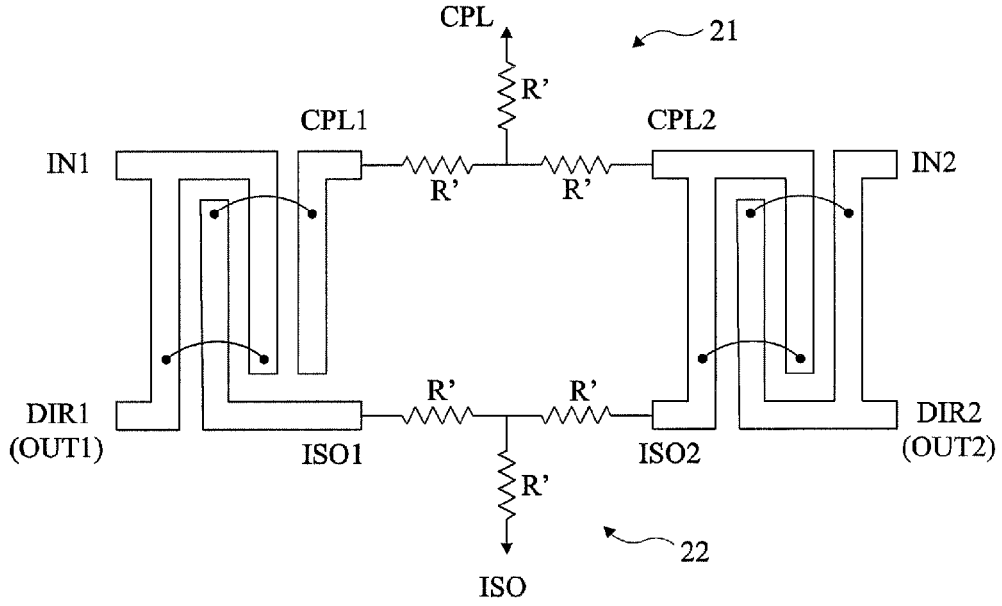
FIG. 9 is a simplified representation of an embodiment of a dual-path coupler.

FIG. 9 illustrates an embodiment of a distributed-line coupler. The coupler is, for example, formed of two so-called Lange couplers, interconnected by two resistive power splitters 21 and 22. Other types of couplers may be used. The splitters are T-shaped, that is, internal accesses CPL1 and CPL2 are interconnected by two resistors R' in series having their junction point connected, by a third resistor R', to terminal CPLD. The same structure is provided on the side of terminal ISO between accesses ISO1 and ISO2.

The length of each Lange coupler depends on the frequency band of the concerned path. Resistors R1 are selected to have identical values corresponding to ⅓ of the impedance matching of the circuit (typically ⅓ of 50 ohms, that is, 16.67 ohms)

The intrinsic directivity of each coupler is not impacted by the other coupler due to the use of splitters.

The power divider formed by the resistive assemblies allows a good matching between the two couplers.

Each coupler of FIG. 9 may have its secondary line cut in two, in accordance with the embodiment of FIG. 6. To obtain a symmetrical operation, the cutting is, preferably, performed in the middle of each secondary line.

Specific embodiments of the present invention have been described. Different variations and modifications will occur to those skilled in the art. In particular, the line dimensions according to the frequency bands desired for the coupler can be determined by those skilled in the art with the usual methods.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A distributed-line directional coupler comprising:

a first conductive line between first and second ports to convey a signal to be transmitted; and a second conductive line, coupled to the first conductive line, between third and fourth ports, wherein the second line is interrupted approximately at its middle, the two intermediary ends of the second conductive line being connected to attenuators.

2. The coupler of claim 1, wherein the attenuators have values of at least half a directivity factor of the distributed-line directional coupler.

3. A directional coupling circuit comprising two couplers of claim 1 interconnected by two resistive power separators.

4. A circuit for transmitting or receiving radio-frequency signals, comprising:

at least one amplifier;

at least one distributed-line directional coupler of claim 1; and at least one circuit for measuring information sampled from one of the ports of the second conductive line.

5. A directional coupler comprising:

a first conductive line between first and second ports to convey a signal to be transmitted; and a second conductive line, coupled to the first conductive line, between third and fourth ports, wherein the second conductive line is interrupted approximately at a middle of the second conductive line, the two intermediary ends of the second conductive line being connected to attenuators, and wherein each attenuator comprises a plurality of resistors connected in a pi-coupled resistor network.

6. A distributed-line directional coupler comprising:

a first conductive line between first and second ports to convey a signal to be transmitted; and a second conductive line, coupled to the first conductive line, between third and fourth ports, wherein the second conductive line is interrupted approximately at its middle, the two intermediary ends of the second conductive line being connected to attenuators, and wherein the attenuators have values of at least half the directivity factor of the distributed-line directional coupler.

* * * * *